United States Patent [19]

Calderon

[11] 4,389,283

[45] Jun. 21, 1983

[54] METHOD FOR MAKING COKE VIA INDUCTION HEATING

[76] Inventor: Albert Calderon, 1065 Melrose Dr., Bowling Green, Ohio 43402

[21] Appl. No.: 229,317

[22] Filed: Jan. 29, 1981

Related U.S. Application Data

[63] Continuation-in-part of Ser. No. 201,699, Oct. 29, 1980, abandoned.

[51] Int. Cl.[3] ..... C10B 51/00; C10B 57/00; C10B 57/18

[52] U.S. Cl. ..... 201/19; 201/26; 201/32; 201/34; 201/39

[58] Field of Search ..... 201/8, 10, 13, 19, 29, 201/34, 39, 44, 18, 38, 1, 26, 32; 202/223, 108, 120, 99, 228, 227; 422/199, 106; 48/65, 210

[56] References Cited

U.S. PATENT DOCUMENTS

| | | | |
|---|---|---|---|
| 972,864 | 10/1910 | Jewett | 48/202 |
| 1,097,513 | 5/1914 | Benner | 48/202 |
| 1,480,045 | 1/1924 | Bowie et al. | 202/108 |
| 1,524,784 | 2/1925 | Bartolomeis et al. . | |
| 1,671,673 | 5/1928 | Doerschuk et al. . | |
| 1,713,189 | 5/1929 | Marshall | 48/202 |
| 1,758,524 | 5/1930 | Koppers | 201/34 |
| 1,759,173 | 5/1930 | Smith . | |
| 1,785,428 | 12/1930 | Smith . | |
| 1,923,213 | 8/1933 | Karrick | 201/19 |
| 2,094,946 | 10/1937 | Hubmann | 48/202 |
| 2,364,130 | 12/1944 | Clancy | 165/169 |
| 2,406,640 | 8/1946 | Siecke | 201/19 |
| 2,438,199 | 3/1948 | Becker | 201/19 |
| 2,509,921 | 5/1950 | Gwynn | 373/141 |
| 2,683,657 | 7/1954 | Garbo | 48/202 |
| 2,701,787 | 2/1955 | Hemminger et al. . | |
| 2,704,662 | 3/1955 | Kocks | 266/24 |
| 2,786,747 | 3/1957 | Gallusser | 75/11 |
| 2,834,665 | 3/1958 | Rudolph et al. | 48/62 R |
| 3,117,072 | 1/1964 | Eastman et al. | 208/11 |
| 3,118,746 | 1/1964 | Stratford | 48/197 |
| 3,171,795 | 3/1965 | Fagnant | 201/18 |
| 3,377,266 | 4/1968 | Salnikov | 201/34 |
| 3,434,932 | 3/1969 | Mansfield | 201/32 |
| 3,509,027 | 4/1970 | Savage et al. | 201/16 |
| 3,550,372 | 12/1970 | Craig | 60/39.02 |
| 3,689,240 | 9/1972 | Aldridge et al. | 48/214 |
| 3,807,961 | 4/1974 | Markel | 422/199 |
| 3,847,092 | 11/1974 | Gilbert | 422/106 |
| 3,882,671 | 5/1975 | Nebgen | 60/39.02 |
| 3,890,113 | 6/1975 | Child et al. | 48/210 |
| 3,929,615 | 12/1975 | Linden et al. | 208/11 R |
| 3,948,640 | 4/1976 | Elvander et al. | 75/11 |
| 3,959,084 | 5/1976 | Price | 201/39 |
| 4,019,314 | 4/1977 | Springmann | 60/39.02 |
| 4,060,479 | 11/1977 | Barcellos | 208/11 R |
| 4,067,700 | 1/1978 | Switzer | 48/210 |
| 4,086,262 | 4/1978 | Chang et al. | 260/449.6 R |
| 4,132,065 | 1/1979 | McGann | 60/39.02 |
| 4,195,978 | 4/1980 | Anderson | 48/62 R |
| 4,242,125 | 12/1980 | Colavtti | 75/37 |
| 4,288,294 | 9/1981 | Velling | 201/39 |

FOREIGN PATENT DOCUMENTS

| | | | |
|---|---|---|---|
| 275354 | 6/1914 | Fed. Rep. of Germany | 201/39 |

OTHER PUBLICATIONS

Perry; Chem. Eng'r. Handbook; 25–41–43; 4th Ed.; 1963.

*Primary Examiner*—Bradley Garris
*Attorney, Agent, or Firm*—Yount & Tarolli

[57] ABSTRACT

An improved method and apparatus for making coke wherein the coal is heated by the walls of a multi-cell chamber means and wherein said walls are heated by electric induction in the absence of air; the raw gases from the coal are directed to a by-product plant. The coal is introduced into said chamber means and the coke is discharged from said chamber means in such a way as to provide positive displacement of both the coal and the coke to overcome the sticking and bridging properties of the coal and the coke within said chamber means. Also improved provisions are included for insuring the sealing of said chamber means while operating said chamber means under a positive pressure in order to increase the efficiency of the conversion of coal to coke without causing pollution. The coal, after being coked, is quenched to a temperature below its ignition point before being exposed to the atmosphere to prevent it from burning in order not to cause pollution nor lose yield.

35 Claims, 7 Drawing Figures

METHOD FOR MAKING COKE VIA INDUCTION HEATING

The present invention is a continuation-in-part of the applicant's co-pending application bearing Ser. No. 06/201,699 and filed on Oct. 29, 1980, now abandoned.

This invention relates to an improved method and apparatus for making coke as used in steel mills and foundries and in particular this invention is an improvement over the method and apparatus of making coke in ovens generally known in the art as slot-ovens and described on pages 93–112 of "The Making, Shaping, and Treating of Steel," 7th Edition. The disadvantages of commercially used slot-ovens mentioned above are as follows:

a. Serious pollution problems that heretofore have not been solved.
b. They require a very great capital investment.
c. Difficult to maintain.
d. Inefficient in heat transfer for the devolatization of the gases contained in the coal.
e. Wasteful in energy.
f. Require special blends of coal which are costlier and not plentiful. Since coke is an essential commodity for making iron in blast furnaces the United States faces a critical shortage of coke as evidenced by the study made for the Commerce Department by the Industrial Economics Research Institute of Fordham University titled, "Analysis of the United States Metallurgical Coke Industry" and authored by William T. Hogan, S. J. and Frank T. Koelble, dated Oct. 1979 and a copy of the summary of the study being attached herewith and labelled Exhibit 1. Other systems of making coke have been proposed such as the patent issued to Karrick dated Aug. 22, 1933 bearing U.S. Pat. No. 1,923,231 which discloses the use of resistance heating for the making of coke.

Another patent issued to Salnikov dated Apr. 9, 1968 bearing U.S. Pat. No. 3,377,266 teaches the electrothermal pyrolysis of oil shale wherein the heat for the pyrolysis is supplied by resistance heating and described in column 3, paragraph 2. This same patent also makes reference to the use of induction heating for the pyrolysis of the shale.

In the commercial production of coke, the following factors are critical:

(i) Prevention of pollution to safeguard the environment.
(ii) Productivity from an operating unit to be commercially competitive.
(iii) Low capital investment.
(iv) Maintenance kept at a minimum to reduce exposure of workers to hazardous conditions which are prevalent when coal is processed.

The instant invention which meets the above criteria, is in addition very efficient in heat transfer, has controllable features for uniformity of operation, does the heating of the coal by direct contact without short-circuiting and arc-ing, is efficient in heat recovery, is capable of making coke from lower grades of coal.

The instant invention is an improvement over the method and apparatus of the applicant's co-pending application referred to in the preamble of this application. Briefly, the said co-pending application teaches the making of coke in an enclosed chamber "A" which possesses shaft 11, which shaft is wrapped by induction coil means 31, and is made up of a plurality of cells 35 grouped together in the form of a cluster with induction coil means 31 surrounding the entire cluster. In particular one of the improvements of the instant invention resides in the provision of a positive displacement means to insure the feeding of the charge into said cells and movement of the charge within said cells to prevent bridging. Actual experiments carried out on a cell, photograph attached and labelled Exhibit 2, proved that the coal and the coke made from it do not flow into and within said cell unless pushed by a positive means. It is a fact that on page 5, lines 21–25 in the applicant's co-pending application disclose the tapering of cells 35; however in practice the taper is not a factor in the feeding of the coal into the cells and is not positive enough to overcome the acute bridging that has been heretofore experienced. Another improvement resides in increasing the efficiency of coking by positively pressurizing chamber "A" whilst at the same time gas containment without leakage is guaranteed. Ejector means 14 disclosed on page 8, line 25 of said co-pending application being in the form of a ram, makes the sealing of chamber "A" difficult. Further alternate arrangements are provided for handling the devolatilized gases. Such improvements are provided to further improve the method and apparatus disclosed in said co-pending application to result in an efficient and uniform heat transfer coupled to movement of the material within shaft 11 in order to make carbonization of coal continuous, successful and commercially dependable.

The now practiced method of making coke is inefficient because the source of heat originates from a flue which heats up one side of a brick wall which wall is essentially an insulator, while the unheated side of said brick wall in turn heats the coal. Other improvements of this invention are: the efficient method of heating the cells above carbonization temperatures, the mounting of the cells in the shaft, the insulating of the cells from each other, the sealing of the chamber when operating under positive pressure, provisions for replacement of heating cells, the provision for continuity of operation as compared to a batch process, positive flow of material within the shaft, and elimination of insulation which is erodable between the heating elements and the coal or coke.

The patent issued to Karrick bearing U.S. Pat. No. 1,923,231, is different from the instant invention, in being a slow and low temperature, batch operation using resistance heating in the form of "heavy metallic cables or chains" which are strung within the shaft. At the completion of the coking cycle which lasts from a few days or up to two weeks, the flexible heating element is forcibly withdrawn in either direction to tear the coke apart. Once the coke is removed from the carbonizing chamber, the heating element is restrung in a spiral or zig-zag form. As will be shown hereinafter, the instant invention is both structurally and operationally critically different.

The patent issued to Salnikov bearing U.S. Pat. No. 3,377,266 is different from the instant invention. It teaches the pyrolyzing of shale by the use of electrothermal means made up of resistance heating elements 52 (see column 3, line 18). These resistance elements are in turn made up of elongated metallic rods 54 having an outer jacket of a ceramic material 55. The patent further teaches (column 4, line 6) that the outer protective jacket 55 serves "to insulate the rods from direct physical contact with the shale." The patent also teaches that "other forms of electrical heating elements may be employed in the manner prescribed in accordance with the present invention such as for example, induction heating elements."

The instant invention teaches a method and apparatus for the making of coke wherein the shaft in which carbonization takes place is made up of a cluster of compartments or cells, shown by "c" in the photograph attached and marked Exhibit 2. Each compartment "c" possesses walls "d". The inside of walls "d" are in direct contact with the coal charged. The outside of walls "d" are insulated both thermally as well as electrically by means of insulation "e" so that each cell is an island in itself without the possibility of ever having the walls of one cell making contact with the walls of an adjacent cell. The whole cluster of cells is in turn insulated by insulation "b" which surrounds the cluster; insulation "b" is provided to thermally insulate the cluster from the induction coil which is water-cooled and located in the area denoted by "a".

It is a fact that Salnikov makes reference to the substitution of resistance heating by induction heating, but his patent fails to describe how induction heating would heat the shale in such a manner as to provide efficient heat transfer as taught by the instant invention. Since it teaches the use of a ceramic insulator between the heating rod and the shale, this manner of heating is similar to conventional coke ovens wherein one side of a brick wall is heated and the other side is in contact with the coal; it also fails to teach how short-circuiting and arc-ing will be prevented after wear of the ceramic insulator covering the heating rod takes place since coal but especially coke is very abrasive. Arc-ing would overheat the coal and cause clinkers. Other detrimental problems in applying Salnikov's patent to make coke are blockage in the shaft preventing the continuous flow of material caused by the interference of horizontal members of frame 56 which horizontal members support heating elements 52; further the excessive heating of the base of each heating rod 54 because of the insulating properties of ceramic jacket 55 will occur. The temperature of distillation of shale is on the order of 900° F. to 1000° F., wherein coking of coal for commercial usage ranges from 1600° F. to 2000° F. Such temperature range coupled to the abrasive properties of coke will render the ceramic jackets of Salnikov short lived. Further yet Salnikov does not disclose the employment of a shaft made up of a cluster of cells insulated and isolated from each other wherein the inside walls of the cells are uniformly heated by induction and wherein the inside of said walls are in direct contact with the coal to be devolatilized, and no insulation is interposed between the heated walls of the cells and the coal itself. Such structure which is conducive for scale up by multiplying the number of cells in the cluster will always provide very efficient heating of the charge without concern for the abrasive properties of coal and coke, and in this manner eliminating the possibility of arc-ing or short-circuiting between and among the walls of the cells. The cells are completely open along their length and may even be tapered to diverge downwardly to prevent any blockage or bridging in order to insure a semblance of continuity to the commercial production of coke. Further yet, the instant invention discloses a positive arrangement for distributing the coal into cells and for maintaining the movement of the coal downwardly within each cell. Salnikov's patent does not disclose either operationally or structurally as that which is disclosed by the instant invention. It is a fact that Karrick does disclose chains strung in a pattern such as a zig-zag pattern within the shaft; after the completion of coking which in the case of Karrick as a batch operation takes several days, the chains are pulled to break up the coke. Karrick does not disclose the cluster of cells, within which coking takes place, the distribution of the coal, the feeding of the coal in the cells and the positive means to push the coal into them to guarantee movement of the charge continuously. It is evident that Karrick's invention is neither operationally nor structurally similar to the present invention.

The instant invention discloses a method and apparatus that is adaptive to making coke in a completely environmentally closed system with very efficient and controllable heat transfer features irrespective of the erosive characteristics of coal and/or coke, which invention is capable of carbonizing commercial quantities of coal. Such quantities are a prerequisite to industrial productivity in order to make the system competitive in addition to environmentally sound. The positive movement of the coal and coke being an absolute requirement for dependable productivity.

Therefore, the main object of the instant invention is to provide a chamber that efficiently carbonizes coal by transferring heat directly and uniformly to the coal to be carbonized in a completely closed system to comply with the Clean Air Act and OSHA standards.

Another object of the instant invention is to provide a method and apparatus that are conducive to scaling up to commercial sizes to satisfy the critical needs of industry.

Further an object of the instant invention is to provide a method and apparatus that require a relatively low capital investment for facilities to produce coke on a commercial scale.

Yet a further object of the instant invention is to provide a method and apparatus that require low maintenance and which are capable of overcoming the problems presented by the severe erosive properties of coal and coke.

Further another object of the instant invention is to provide a method and apparatus that furnish heat by means of induction coil means surrounding a cluster of cells whose external walls are insulated in such a way as to force the heat to flow inwardly of the cells so that the coal to be carbonized contained within each cell is efficiently heated by the direct contact of the coal with the internal walls of each cell.

Yet another object of the instant invention is to provide a method and apparatus wherein the heat transfer from the internal walls of said cells to the coal to be carbonized is further improved by providing internal fins to said internal walls in order to reduce the time of carbonization.

Further yet another object of the instant invention is to provide a method and apparatus wherein a plurality of heat zones are provided to selectively control the heat input into said cells.

It is another object of the instant invention to provide a method and apparatus wherein the cells contained in said chamber are insulated and isolated from each other in such a way as to provide the uniform heating of each cell and the prevention of short-circuiting or arc-ing between said cells.

Still another object of this invention is to provide a method and apparatus wherein coal is distributed uniformly into each cell contained in said chamber in such a way as to provide a balance in the heating procedure in order to obtain a product that is uniformly coked.

It is therefore another object of the instant invention to provide a method and apparatus wherein provisions are made to guarantee the flow of the coal and coke within said cells to prevent bridging by positively pushing the coal into each cell to guarantee movement of the material during the coking operation.

It is yet another object of the instant invention to provide a method and apparatus wherein provisions are made to efficiently preheat the coal before devolatilization.

It is further another object of the instant invention to provide a method and apparatus wherein provisions are made for the efficient recovery of the by-products of coal generated during carbonization.

It is further yet another object of the instant invention to provide a method and apparatus wherein provisions are made for the efficient heat recovery from the coke after carbonization for energy conservation.

Therefore, further another object of the instant invention is to provide a method and apparatus capable of making coke from lower grades of coal to supplant the reserves of expensive metallurgical coals.

Other objects of this invention will appear from the following detailed description and appended claims. Reference is made to the accompanying drawings forming a part of this specification wherein like reference characters designate corresponding parts in the various views.

Before explaining in detail the present invention it is to be understood that the invention is not limited to the details of construction and the arrangement of the parts illustrated on the accompanying drawings since the invention is capable of other embodiments. Also it is to be understood that the phraseology or terminology herein is for the purpose of description and not limitation.

DETAILED DESCRIPTION OF DRAWINGS

Figure 1:
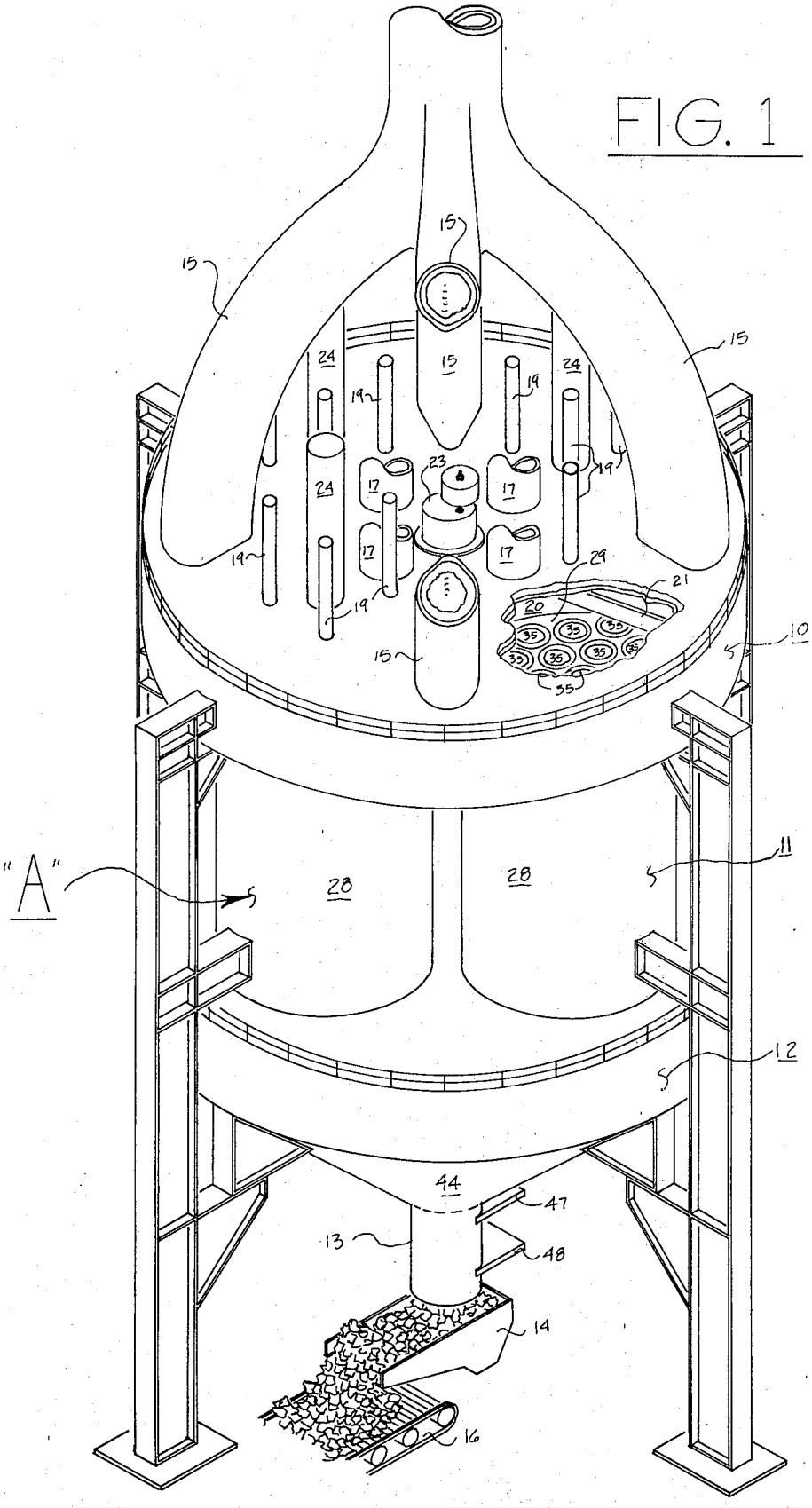
FIG. 1 is a schematic three dimension drawing of the invention. It shows the top, the shaft, the quenching hopper, the coal chutes, the coke discharge and the gas collection.
Figure 2:
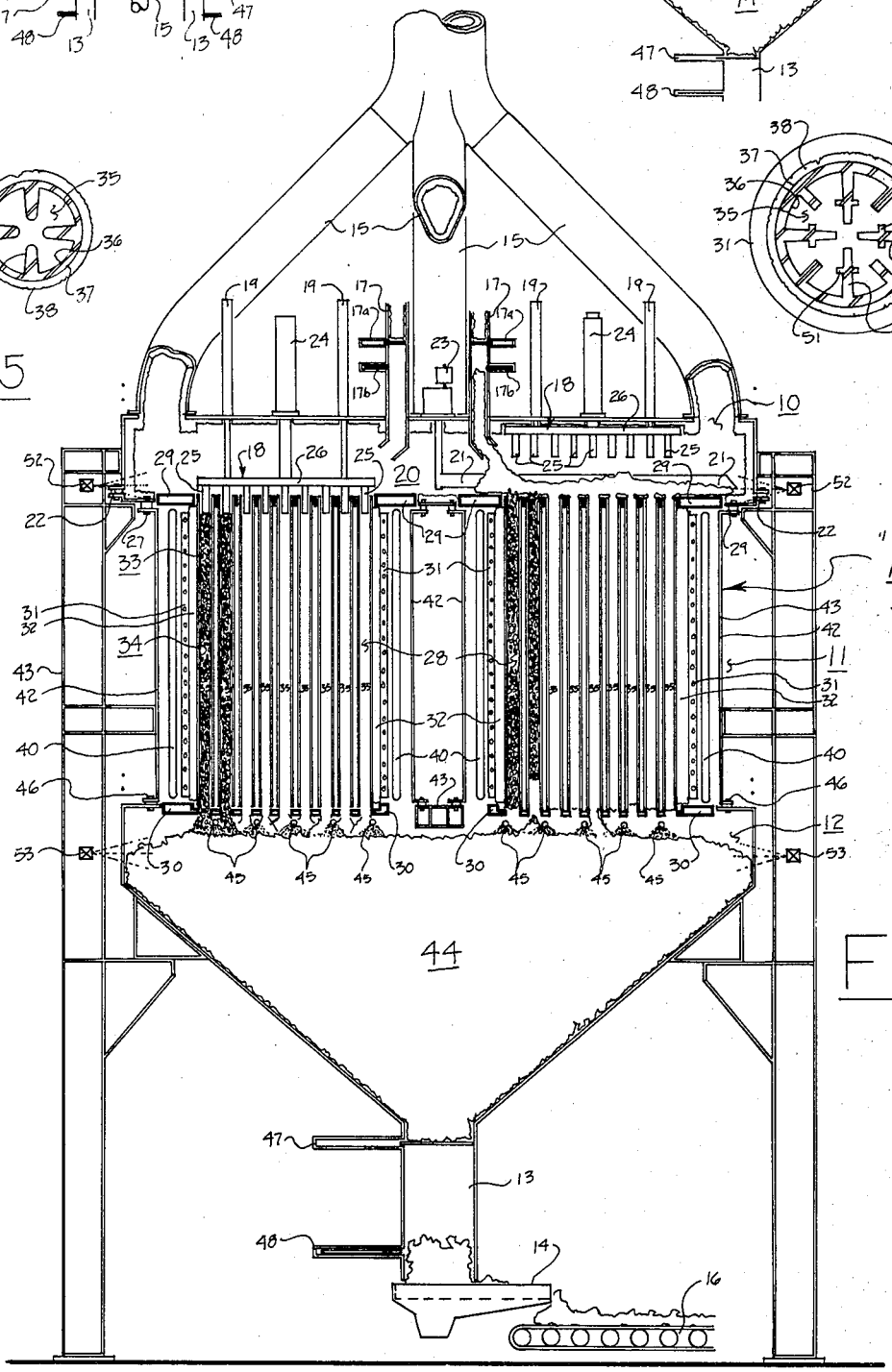
FIG. 2 is a vertical section through the invention. It shows the top which comprises the coal feeding arrangement, the distribution system for the coal, the plunger assembly for feeding the coal into the shaft and the gas collection. It also shows the multi-cell arrangement surrounded by induction coils. Below the cells the quenching hopper is located.

In FIGS. 1 and 2, reference letter "A" represents the chamber in which the coking cycle takes place. Chamber "A" which takes the form of a vertical retort possesses a top 10 for receiving, distributing and feeding the coal charged and also for evacuating the gases devolatilized from the coal, a shaft 11 for pre-heating and coking of the coal, which shall be described in further detail later on, and a hopper 12 for quenching the coke. Chamber "A", above top 10, possesses gas off-take 15 to direct the raw gases to the by-product plant (not shown). Beneath quenching hopper 12 discharge means 13 is situated. A conveyor 16 is located under discharge means 13 to transport the quenched coke to storage or for immediate use. Feeder 14 is interposed between discharge means 13 and conveyor 16.

As shown in FIGS. 1 and 2, top 10 is made up of the following: (a) coal handling chutes 17 to deliver coal to Chamber "A", (b) distribution hopper 20 to contain the coal for delivery into shaft 11, (c) coal levelling rotor 21 for levelling the coal within distribution hopper 20, (d) plunger 18 assembly to push the levelled coal into shaft 11, preferably by means of vertically activating hoisting cylinders 19, and (e) support means 22 to hold top 10 in place. Distribution hopper 20 is refractory lined to maintain the temperature within top 10 preferably above 900° F. to minimize tar condensation. Levelling rotor 21 is driven by drive 23. For ease of maintenance top 10 may be mounted on a car as shown and described in the co-pending application referred to above. Plunger 18 is preferably guided by means of guide 24 to provide continuous alignment. Plunger 18 is provided with a plurality of punches 25 which extend downwardly and serve to push the coal into each cell of shaft 11. Punches 25 are mounted on disc 26 which disc in turn is connected to hoisting cylinders 19. Top 10 is preferably flange-bolted to shaft 11 by means of bolt assembly 27.

As is also shown in FIG. 2, shaft 11 comprises the following: (a) cell section 28, (b) upper support 29 for cell section 28, (c) lower support 30 for cell section 28, (d) induction heating coil means 31, and (e) insulation 32. Cell section 28 is divided into two parts: part 33 which serves for pre-heating of the coal and part 34 which serves for devolatilization of the coal. Cell section 28 may take the form of one or more cluster of tubes which extends substantially the entire height of shaft 11, occupying the space between top 10 and bottom 12. The tubes preferably are round in configuration such as tube 35. Each tube in the cluster forms a separate and isolated cell or compartment within which the drying, pre-heating and devolatilizing of coal takes place. Cell 35 which possesses thick walls is made preferably of a high temperature material as for example alloy, graphite, silicon, iron, silicon carbide, etc., to withstand a coking temperature exceeding 1500° F. One of the main factors controlling productivity of Chamber "A" is the number of cells contained in shaft 11. Each cell such as tube 35 has a relatively small capacity in itself but with a plurality of cells assembled in a cluster and several clusters put together, the capacity is considerably increased. Cell 35 may be tapered to diverge downwardly to minimize bridging as the coal moves within each cell. Each cell such as cell 35 has an inner wall 36 and an outer wall 37. Insulation 38 surrounds outer wall 37 to minimize heat loss and maintain the inside wall as hot as possible in order to drive the heat towards the inside of cell 35 where the coal is contained. This arrangement also eliminates the possibility of having the short-circuiting or arc-ing take place between the cells. For the above reasons, the outer walls of cells 35 are insulated and isolated from each other both thermally as well as electrically. In order to guarantee uniform and efficient heating in a large diameter chamber such as 30 or 40 feet in diameter to make possible the competitive production of coke in commercial scale, I provide one or more than one cluster of cells which are bunched together, yet insulated and isolated from each other with induction coil means 31 surrounding the entire cluster rather than each cell surrounded by a coil. In so doing I have discovered that when current flows through said coil means 31 I heat each cell efficiently and uniformly irrespective of the number of cells and irrespective of the location of any cell as long as each cell is insulated and isolated both electrically and thermally from and adjacent cell. Evidence to this effect is demonstrated in Exhibit 2 mentioned above and also by the attached letter from Professor St. Pierre of Ohio State University to Dr. Dennis of A.I.S.I., marked Exhibit 3. The height of cells 35 is such that when the coal which is charged in top 10 reaches the bottom of shaft 11, the coal is dried, pre-heated and devolatilized resulting in fully coked coal.

Each cell is supported at the top by upper support 29 and held in place at the bottom by lower support 30. Upper support 29 which may be water-cooled is made in the form of a tube-sheet, as used in heat exchangers such as surface condensers. Lower support 30 is preferably water-cooled and also made in the form of a tube-sheet.

Induction coil means 31 is made up of a plurality of coils spaced apart in such a way as to provide zonal heating in order to give maximum control. Coils 31 are water-cooled and are tied to a suitable source for power. Electric shunting such as shunt 40, as shown in FIG. 2, is also provided to insure that the flux outside coil 31 is controlled in order to prevent the overheating of physical structures 42 and 43 outside of coils 31. Since coils 31 are water-cooled, insulation 32 is interposed between coils 31 and the cells 35.

Referring to FIG. 2, below shaft 11, bottom 12 is located. This bottom which is in the form of a heavy structure serves to receive the coke and to quench it. Preferably bottom 12 is made up in the form of hopper 44 equipped with spray nozzles 45 for spraying quenching water on the incandescent coke pushed downwardly from cells 35. A level is maintained within hopper 44 to minimize the drop of the coke from cells 35 and when coke slides downwardly from cells 35. The descent of the coke is arrested by the level maintained in hopper 44. Instead of spraying quenching water, steam may be injected through nozzles 45 to do steam quenching and thereby form water gas. The quenching steam and the water gas formed are forced to rise into cells 35 and join the gases of devolatilization rising within each cell 35, by sealing provisions 46 which make hopper 44 gas tight.

When operating shaft 11 under a positive pressure shaft 11 is provided with an outer shell 42. Shell 42 is flange mounted to top 10 and to bottom 12 and in this manner fully sealing Chamber "A" to prevent gases from escaping into the atmosphere. It is preferable to operate Chamber "A" under a positive pressure in order to increase the efficiency of carbonization. In pressurizing Chamber "A" double gate valves 47 and 48 are provided to prevent gas from leaving hopper 44 when discharging the quenched coke.

Figure 4:
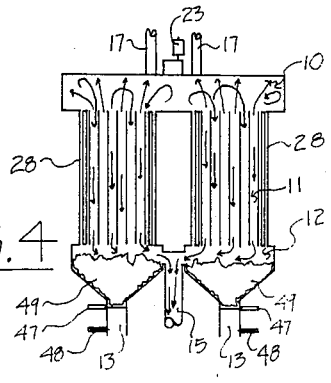
FIG. 4 is still another variation of the invention wherein the gases of devolatilization are forced downwardly and are extracted from the bottom of the multi-cell arrangement.
Figure 7:
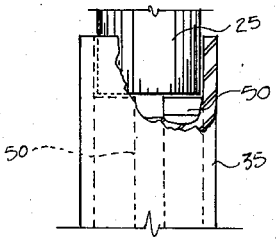
FIG. 7 is a partial sectionalized view, showing an enlargement of the punch means that pushes coal into the carbonizing cell.
Figure 3:
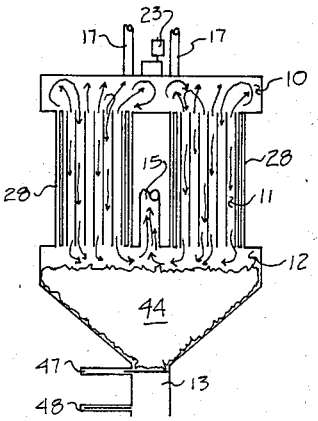
FIG. 3 is a variation of the invention wherein the gases of devolatilization are forced downwardly and re-directed upwardly.
Figure 5:
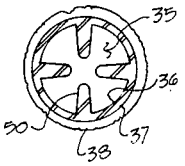
FIG. 5 is a cross-section of one of the cells which is provided with fins for improving heat transfer.
Figure 6:
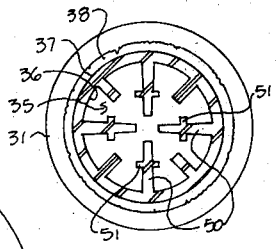
FIG. 6 is still another cross-section of one of the cells which is provided with fins which are equipped with additional surface protrusions to further still improve the heat transfer to the coal.

Instead of collecting the gases from top 10 of Chamber "A" other variations are possible. As shown in FIG. 3, the collection of gases of devolatilization are forced downwardly through cells 35 and collected in duct 15 which is situated in such a way as to redirect the gases upwardly after joining with the gases of quenching. FIG. 4 is still another variation wherein bottom 12 is subdivided into separate quenching hoppers with each cluster 28 having its own quenching hopper 49, with the gases of devolatilization and the gases resulting from quenching being collected from the bottom of Chamber "A" without the upward redirection. In order to increase the efficiency of heat transfer of cells 35 each cell is equipped with internal fins 50. Fins 50 preferably extend the entire length of cell 35 except at the very top where punch 25 penetrates the top of cell 35 to positively feed the coal from distribution hopper 20 into each cell 35. Fins 50 may possess additional protrusions such as protrusion 51 to further increase the heat transfer, this being shown in FIG. 6. The increased surface created by the fins and the protrusions possess the capability of reducing the number of cells 35 to even a single cell in certain cases.

While the operation of the method and apparatus of the present invention may be comprehended from a study of the foregoing description, it is believed that the operation may be further explained as hereinafter set forth.

OPERATION

Referring to the drawings and assuming that Chamber "A" is in the process of coking, coal is charged into distribution hopper 20 by the selective operation of gates **17*a* and 17*b* to create smokeless charging. The coal leaving chute 17 falls into hopper 20 forming a pile. Coal levelling rotor 21 sweeps the coal pile and levels it above the top of cells 35. A level of one to several feet of coal is maintained at all times in hopper 20 in order to have coal for cells 35 with no interruption. Since the temperature of top 10 is maintained above 900° F., some of the coal charged becomes tarry and even sticky; its feeding into each cell 35 is aided by plunger 18 assembly to positively push the coal into each cell by means of punches 25, with one-punch penetrating the top of one cell. Punches 25 are so spaced as to be in perpetual alignment with cells 35 to insure the penetration of the individual cells without causing damage to the top of cells 35. Punches 25 are made smaller in diameter than the diameter of the top of each cell, in order to provide clearance between the inside wall of the cell and the outside wall of the punch. The pushing of coal into each cell also forces the positive downward descent of the coal and coke within each cell 35. By this manner of feeding coal, coke is fed out of cells 35 and into hopper 44 for quenching. By means of a level control 52 to control the level of the coal in distribution hopper 20 and by means of level control 53 to control the level of coke in quenching hopper 44, the system feeds a certain amount of coal into each and every cell 35, and pushes out of each and every cell 35 a certain amount of coke. This happens periodically in a semi-continuous cycle with a predetermined amount of coal, as for example one to two feet of coal every several minutes. Level controls 52 and 53** may be of the gamma ray type or any other commercially available suitable control.

The initial heating of the coal takes place in pre-heating section 33 where the moisture is driven off and the temperature of the coal is raised by the volatiles from devolatilization section 34. The coal contained within cells 35 keeps descending within each cell while the coke is ejected from bottom of shaft 11 into quenching hopper 44. Upon entering devolatilization section 34, the coal is effectively heated by direct contact with inside walls 36 which are red hot and exceeding 1500° F. in temperature. Initially, the coal that is contiguous to walls 36 is heated first because of direct contact with the hot walls and as this coal is devolatilized, the heat from the walls pushes the volatiles towards the center of each cell. To enhance the heating, insulation 38 wrapped around each cell, practically prevents any heat from leaving each cell from outer walls 37. Insulation 38 coupled to castable refractory 32 makes an ideal arrangement for driving the heat into the coal by direct contact with inside walls 36 of cells 35. To further improve the heat transfer, fins 50 which are an integral part of inside wall 36 convey the heat inside cell 35 because fins 50 also become red hot the same as walls 36 by induction. To further still improve the heat transfer, protrusions 51 are added to fins 50. All this takes place within each cell 35 but independently from each other, so that each cell does its intended heating without being affected by gas channelling, refractory wear, short-circuiting, arc-ing or bridging.

In operating shaft 11 under pressure and in maintaining the top temperature around 900° F., the methane content of the gas of devolatilization will be the highest since under pressure, the hydrogen gas generated from water gas formation by the quenching of the coke reacts with the coal that is being decomposed to make methane and at the same time give off heat, the formation of methane being an exothermic reaction. The methane rising from cells 35 into top 10 is prevented from cracking because of keeping the temperature in top 10 below the methane cracking temperature but above the condensation of tar.

The gases of devolatilization which mainly comprise hydrogen and methane leave top 10 through duct-work 15 and are processed by conventional means as practiced in a by-product plant which usually adjoins the coke plant. All the gases leaving pre-heating section 33 and devolatilization section 34 are captured and piped out of Chamber "A" via duct-work 15 and directed to the by-product plant (not shown). As the coal keeps descending in cell 35, by a combination of plunger 18 assembly which comprises mechanical pressure and by internal pressure, the coal and the coke is kept in motion downwardly, while the carbonization of the coal continues on a continuous cycle, and by the time the coal reaches the bottom of shaft 11, the coal is fully coked.

As the coke is pushed out of cells 35 it is either quenched with water or dry-quenched with steam by means of nozzles 45. The steam formed by the evaporation of the quenching water is re-acted with the hot coke and is transformed to water gas which rises in cells 35 and joins the volatiles which are in the process of being driven out of the coal. The level of the coke within hopper 44 is maintained by level controls 53 in order to provide support to the coal and coke contained within each cell, in the event of a "slip". A slip is when the coal and coke do not stay within the cell of their own accord and keep sliding by gravity out of cells 35. After dropping the temperature of the coke, slide-gate valves 47 and 48 are selectively operated in order to feed coke out of hopper 44 onto conveyor 16 via any suitable means such as feeder 14.

It is to be noted that with a cluster of cells bunched together great productivity can be attained with low operating cost and minimum investment and at the same time providing a fast acting unit that will produce coke incorporating coal preheat, carbonization and quenching in a closed system which will comply with EPA and OSHA. In years gone by, quenching of coke in a tower was a good way of disposing contaminated water but with the Clean Air Act such disposal in recent years has been outlawed. The disposal of such water has been a very great problem to coke oven operators. With the instant invention the disposal of such contaminated water can be practiced again for quenching purposes since the instant invention is completely closed and the quench water which is evaporated is mixed with the volatiles. It is essential, however, to make the materials handling such water out of stainless of corrosion resistant material. This capability of water disposal will be of great help to the environment as well as to the operators.

In providing shaft 11 with means to evacuate the gases from the bottom of cells 35 as shown by FIGS. 3 and 4, any one cluster 28 may be operated completely independent from an adjacent cluster. In so doing it is evident that separate charging means, coal distribution means, positive coal feeding means, discharging means, quenching means and coke feeding means will have to be provided, and also inclusive a gas control damper means to isolate the gas discharge of the cluster from main duct 15. In this manner each cluster 28 can be isolated as a module for maintenance purposes while still operating the other clusters. Also it is to be noted that in cases where it is preferred not to recover the tars and the oils in the coal the gases collected from the bottom of cells 35 are subjected to the high temperature of the walls of the cells and of the red hot coke in order to crack such tars and oils to end up with only gases. Further in the collecting of the gases from the bottom of cells 35 as shown in FIGS. 3 and 4 it is possible to operate top 10 of Chamber "A" at low temperatures.

From the foregoing detailed disclosure, it is evident that the instant invention is a contribution of great significance to the art of making coke which is a critical ingredient for making steel. Further it has the potential to produce energy in the form of a rich medium Btu gas from cheaper coals, to improve the environment, to eliminate health hazards to workers in coke oven plants, to improve the balance of payments, to conserve capital and improve profitability of steelmakers whose economic plight has forced them to shut down several production facilities particularly because of lack of funds for pollution control devices for coke ovens. In fact, the instant invention is of such significance when analyzed strictly from an energy producing source, that it can also be said that this invention produces energy as its main product—coke for blast furnaces and gas with by-products as a substitute for natural gas and oil. All in all, it is submitted that the present invention provides a new and useful method and apparatus for making coke and gas that is capable of dependably producing large enough quantities to meet the industrial needs.

I claim:

1. A method of making coke comprising the steps of charging coal into a plurality of compartments whose walls comprise a material which is adaptable to being heated by induction and wherein said plurality of compartments commonly share an induction coil means which surrounds said plurality of compartments and said induction coil means does not individually surround any of said compartments, heating said walls of said plurality of compartments by said induction coil means to cause the devolatilization of the coal contained within each compartment of said plurality of compartments to convert said coal to coke, and discharging said coke from said plurality of compartments.

2. The method as set forth in claim 1 wherein said step of heating said walls of said compartments by said induction coil means is further characterized by the step of isolating each compartment of said plurality of compartments in such a way as to have each compartment separated from its adjacent compartment.

3. The method as set forth in claim 2 wherein said step of isolating each compartment of said plurality of compartments is further characterized by the step of thermally insulating each compartment in such a way as to have the loss of heat from each compartment reduced to a minimum in order to efficiently drive the heat from the walls of each compartment to the coal contained within each compartment.

4. The method as set forth in claim 2 wherein said step of isolating each compartment of said plurality of compartments is further characterized by the step of electrically insulating each compartment in such a way as to have the short-circuiting of the magnetic flux from one compartment to an adjacent compartment reduced to a minimum in order to uniformly heat the walls of said compartments.

5. The method as set forth in claim 1 wherein said step of heating said walls of said plurality of compartments by said induction coil means is further characterized by the step of locating each compartment of said plurality of compartments outside the confines of the other compartments.

6. The method as set forth in claim 1 wherein said step of charging coal into said plurality of compartments is further characterized by the step of distributing the coal charged into said plurality of compartments in such a way as to have substantially the same amount of coal delivered to each compartment of said plurality of compartments.

7. The method as set forth in claim 6 wherein said step of distributing the coal charged into said plurality of compartments in such a way as to have substantially the same amount of coal delivered to each compartment of said plurality of compartments is further characterized by the step of pressing the coal charged into each compartment in order to press the coal downwardly within each compartment.

8. The method as set forth in claim 7 wherein said step of pressing the coal charged into each compartment is further characterized by the step of applying mechanical force in the downward direction substantially across the surface of the coal contained at the top of each compartment to press the coal downwardly and cause the movement of the contents contained within each compartment by compression.

9. The method as set forth in claim 7 wherein said step of pressing the coal charged into each compartment in order to press the coal downwardly within each compartment is further characterized by the step of forcing coke out of each compartment.

10. The method a set forth in claim 9 wherein said step of pressing the coal charged into each compartment and said step of forcing coke out of each compartment are further characterized by the step of controlling the amount of coal pressed into each compartment and controlling the amount of coke discharged out of each compartment.

11. The method as set forth in claim 9 wherein said step of pressing the coal charged into each compartment and said step of discharging coke out of each compartment are further characterized by the step of operating said method semi-continuously.

12. The method as set forth in claim 9 wherein said step of pressing the coal charged into each compartment and said step of discharging coke out of each compartment are further characterized by the step of operating said method continuously.

13. The method as set forth in claim 1 wherein said step of heating said walls of said plurality of compartments by said induction coil means to cause the devolatilization of the coal contained with each of said compartments to convert said coal to coke is further characterized by the step of collecting the products of said devolatilization.

14. The method as set forth in claim 13 wherein said step of collecting the products of said devolatilization is further characterized by the step of employing at least some products of said devolatilization for the drying and preheating of the coal charged.

15. The method as set forth in claim 13 wherein said step of collecting the products of said devolatilization is further characterized by the step of treating said products of said devolatilization to condense the condensables contained in said products.

16. The method as set forth in claim 13 wherein said step of collecting the products of said devolitization is further characterized by the step of cracking at least some hydrocarbons contained in said products of said devolatilization.

17. The method as set forth in claim 13 wherein said step of collecting the products of devolatilization is further characterized by the step of controlling the temperature of said products to above the condensation temperature of tar.

18. The method as set forth in claim 13 wherein said step of collecting the products of devolatilization is further characterized by the step of controlling the temperature and pressure of said products of devolatilization to enhance the formation of methane.

19. The method as set forth in claim 13 wherein said step of collecting the products of devolatilization is further characterized by the step of controlling the temperature of said products to maintain them below the cracking temperature of methane.

20. The method as set forth in claim 13 wherein said step of collecting the products of devolatilization is further characterized by the step of forcing said products to flow downwardly for down-drafting.

21. The method as set forth in claim 13 wherein said step of collecting the products of devolatilization is further characterized by the step of forcing said products upwardly for up-drafting.

22. The method as set forth in claim 13 wherein said step of collecting the products of devolatilization is further characterized by the step of combining the collection of gases in an up-draft and a down-draft direction.

23. The method as set forth in claim 1 wherein said step of heating said walls of said plurality of compartments by said induction coil means to cause the devolatilization of the coal contained within each of said compartments to convert said coal to coke is further characterized by the step of cooling the coke after devolatilization.

24. The method as set forth in claim 23 wherein said step of cooling the coke is further characterized by dry-quenching coke.

25. The method as set forth in claim 23 wherein said step of cooling the coke is further characterized by the step of cooling the coke with contaminated water in order to simplify the disposal of such water.

26. The method as set forth in claim 23 wherein the step of cooling the coke is further characterized by the step of mixing the gases resulting from the cooling of the coke with the products of devolatilization in order to simplify the clean-up of said gases.

27. The method as set forth in claim 1 wherein the step of heating said walls of said plurality of compartments by induction coil means to cause the devolatilization of the coal contained within each compartment of said plurality of compartments to convert said coal to coke is further characterized by the step of subjecting the contents of said compartments to a divergent downward feed.

28. The method as set forth in claim 1 wherein the step of heating said walls of said plurality of compartments by said induction coil means to cause the devolatilization of the coal contained within each compartment of said plurality of compartments to convert said coal to coke is further characterized by the step of subjecting the coal contained within said compartments to supplemental heating surfaces disposed within said compartments.

29. The method as set forth in claim 1 wherein said step of heating said walls of said plurality of compartments by said induction coil means is further characterized by the step of operating said plurality of compartments which is surrounded by induction coil means under a positive pressure to force the gases out of said plurality of compartments under pressure.

30. The method as set forth in claim 29 wherein said step of operating said plurality of compartments under a positive pressure is further characterized by the step of enveloping said plurality of compartments and said induction coil means by an external envelope to contain the gases and prevent pollution.

31. The method as set forth in claim 1 wherein the step of heating said walls of said plurality of compartments by said induction coil means is further characterized by the step of heating said compartments in the vertical direction in zones to result in an efficient and controllable mode of heating.

32. The method as set forth in claim 1 further characterized by the step of pressing the coal charged into each compartment in order to press the coal within each compartment.

33. The method as set forth in claim 32 wherein said step of pressing the coal charged into each compartment is further characterized by the step of applying mechanical force to the surface of the coal contained at one end of each compartment to press the coal into the compartment and cause the movement of the contents contained within each compartment to compress.

34. The method as set forth in claim 33 further characterized by the step of forcing coke out of the other end of each compartment as coal is pressed into said one end of the compartment.

35. The method as set forth in claim 34 further characterized by the step of controlling the amount of coal pressed into one end of each compartment and controlling the amount of coke discharged out of the other end of each compartment.

* * * * *